US007246972B2

(12) United States Patent
Törmälä et al.

(10) Patent No.: US 7,246,972 B2
(45) Date of Patent: Jul. 24, 2007

(54) METHOD FOR USE OF A MARITIME UNIT AND MARITIME UNIT

(76) Inventors: Pasi Törmälä, PL 32, Karjaa (FI) FIN-10301; Iikka Pitkänen, PL 36, Espoo (FI) FIN-02771

( * ) Notice: Subject to any disclaimer, the term of this patent is extended or adjusted under 35 U.S.C. 154(b) by 0 days.

(21) Appl. No.: 10/520,451

(22) PCT Filed: Jul. 8, 2002

(86) PCT No.: PCT/FI02/00617

§ 371 (c)(1),
(2), (4) Date: Jan. 7, 2005

(87) PCT Pub. No.: WO2004/005129

PCT Pub. Date: Jan. 15, 2004

(65) Prior Publication Data

US 2006/0065113 A1 Mar. 30, 2006

(51) Int. Cl.
*E02B 17/08* (2006.01)

(52) U.S. Cl. ..... 405/199; 405/224

(58) Field of Classification Search ..... 405/195.1–199, 405/224; 91/41

See application file for complete search history.

(56) References Cited

U.S. PATENT DOCUMENTS 2,967,400 A * 1/1961 Grant et al. ..... 405/199
2,969,648 A * 1/1961 Rechtin ..... 405/208
3,727,414 A * 4/1973 Davies ..... 405/196
3,876,181 A * 4/1975 Lucas ..... 254/107
4,270,877 A * 6/1981 Post ..... 405/198
4,387,881 A * 6/1983 McDuffie ..... 254/89 H
4,398,847 A * 8/1983 Horowitz et al. ..... 405/199
4,411,408 A * 10/1983 Radovan et al. ..... 254/108
4,427,319 A * 1/1984 Mayr ..... 405/196
4,479,401 A * 10/1984 Korkut ..... 74/527
4,589,799 A * 5/1986 Hotta et al. ..... 405/196
4,655,640 A * 4/1987 Gillis ..... 405/198
4,813,814 A * 3/1989 Shibuta et al. ..... 405/198
5,035,542 A * 7/1991 Bassett ..... 405/227
5,139,366 A * 8/1992 Choate et al. ..... 405/198
5,906,457 A * 5/1999 Choate et al. ..... 405/198
5,915,882 A * 6/1999 Darwiche et al. ..... 405/198
6,030,148 A * 2/2000 Tormala et al. ..... 405/196
6,030,149 A * 2/2000 Foo et al. ..... 405/199
6,652,194 B2 * 11/2003 Ingle ..... 405/198

FOREIGN PATENT DOCUMENTS

DE 3302865 A1 8/1984

* cited by examiner

*Primary Examiner*—Tara L Mayo
(74) *Attorney, Agent, or Firm*—Venable LLP; Eric J. Franklin

(57) ABSTRACT

A maritime unit and a method for operating a maritime unit. The maritime unit includes a frame structure. The maritime unit includes at least three legs moveable between a standby position and an extended position. A jack mechanism moves the legs between the standby position and the extended position. The maritime unit has at least its legs operated on a disk brake principle for enabling a substantially stepless drive therefor, whereby the maritime unit has each of its legs provided with a brake system, including one or more brake flanges extending longitudinally of the leg. The maritime unit has its frame structure provided with a brake system including one or more brake shoe elements operable in a vertical direction with the jack mechanism.

27 Claims, 7 Drawing Sheets

METHOD FOR USE OF A MARITIME UNIT AND MARITIME UNIT

CROSS-REFERENCE TO RELATED APPLICATIONS

This application is the national phase under 35 U.S.C. § 371 of PCT/FI2002/000617 filed 8 Jul. 2002.

FIELD OF THE INVENTION

The invention relates to a method for operating a maritime unit, intended for seafaring, such as marine traffic, offshore operations, and/or the like. The maritime unit includes a frame structure, which is provided with at least power production and/or drive assemblies for the maritime unit, and at least three legs operated by a jack mechanism, on the one hand for steadying the maritime unit on the seabed by driving the legs from a standby position, as required by the maritime unit's shipping condition, downwards in a direction substantially vertical with respect to the frame structure and, on the other hand, for releasing the same from the seabed by driving the legs upward relative to the frame structure.

BACKGROUND OF THE INVENTION

Mobile offshore rigs, especially at present, are designed both as, so-called semi-submersible drilling platforms and so-called jack-up drilling rigs, the latter being provided with legs or columns drivable in a vertical direction with respect to the frame structure of a drilling rig for steadying the drilling rig on the seabed in operating condition. Semi-submersible offshore rigs include an underwater section for supporting the actual working platform on the surface. This type of drilling rig is not secured to the seabed at all in a drilling condition, and therefore, such a drilling rig must be provided with expensive and sophisticated articulation and motion compensating mechanisms between a ground drilling mechanism and an offshore rig in order to enable drilling on rough seas. Both manufacturing and operating costs for this particular type of offshore rigs exceed many times those of the above-mentioned jack-up type drilling rigs.

In particular, Finnish patents Nos. 96896 and 100197 disclose solutions, especially for further development of traditional jack-up type drilling platforms. The solution disclosed in the former of these patents is intended for improving safety and usability aspects in an offshore rig in such a way that living quarters, included in the drilling rig, are designed as a movable unit, whereby, in a preferred application, it is removed, at least for the duration of a drilling operation, in a direction opposite to the traveling direction of a drilling unit.

The latter patent offers a solution, which is intended for improving the usability of a jack-up type drilling rig, particularly in reference to the safety of attachment and detachment procedures. Therefore, below the bottom of a frame structure is provided an air space, which is exhaustible for a shipping condition of the drilling rig and which is injected with air for building an air cushion or the like underneath the drilling rig for the duration of the above-mentioned procedures.

At present, offshore operations are still carried out by using prior known maritime units of so-called liftboat type. FIG. 3 shows a few liftboat solutions of this type, which are applicable at various depths and which are particularly intended for providing assistance in all types of offshore processes by having themselves, in the operational condition thereof, steadied or stabilized on the seabed.

Presently, a particular drawback in the above type of maritime units steadied on the seabed is the primitivity of jack mechanisms operating the legs or columns thereof. The reason for this is that these are conventionally designed with highly traditional mechanisms. Such traditional jack mechanisms, capable of sufficiently smooth hoisting, are generally implemented by using rack-and-pinion operated gear assemblies, which are very slow and highly expensive to design because of long racks. On the other hand, there are presently available a number of jack mechanisms driven directly by hydraulic cylinders, but such hydraulic mechanisms, as available at present, require that, as the stroke of each hydraulic cylinder has come to a stop, each movable leg or column be provided with a tenon-and-mortise locking for the duration of returning this particular cylinder to its starting position for the next stroke and the next tenon-and-mortise locking. As a result, traditional hydraulic mechanisms are not capable of stepless operation. Slowness is further enhanced by the fact that the legs or columns are never level with each other on the bottom of the sea. As the cylinders for one leg or column reach the end positions thereof and stop for relocating the tenons, all the rest of the legs come to a stop as well, even though a relocation of the tenons thereof is not yet called for or even desired. Consequently, such mode of operation is extremely tedious and laborious, in addition to which the automation of processes associated with operating the legs or columns is highly inconvenient and expensive, as such a process requires highly sophisticated accessory equipment, particularly for providing a reliable locking action.

Thus, all prior art operating modes are very slow. In addition, the gearshift-based solutions, capable of continuous hoisting action, are extremely expensive in terms of costs.

SUMMARY OF THE INVENTION

It is an object of a method of the invention to provide a decisive improvement regarding the above-discussed problems, and thus to essentially raise the existing state of the art. In order to fulfil this objective, a method of the invention is principally characterized in that at least the legs of a maritime unit are operated on a so-called disk brake principle for enabling a substantially stepless drive therefor, particularly regarding the manipulation and locking thereof, the maritime unit having each of its legs provided with a brake disk system, such as one or more brake flanges or the like, extending longitudinally of the leg and, on the other hand, the maritime unit having its frame structure provided with a brake system, such as one or more brake shoe elements or the like, operable in a vertical direction by means of a jack mechanism.

The most important benefits gained by a method of the invention include its simplicity and efficiency, as a result of which it is possible to rationalize significantly the available state of the art, regarding particularly the operation of legs or columns in various offshore units. The invention enables manipulation of the legs, such that both the descent and ascent thereof to and from the seabed, as well as the levelling operations of an offshore unit necessary in certain conditions, are feasible in a totally stepless and even fully automated fashion without subjecting the legs to labour-intensive "trimming" operations and mechanical locking actions. Actuation of each leg in a maritime unit is feasible e.g. by means of two or more brake shoe elements, which are set one below the other in a vertical direction and apply their action on a single brake flange in a brake disk system included therein, and which are operated by means of separate jack mechanisms, such as hydraulic cylinders or the like. Hence, it is further possible to provide such a function that each leg of an offshore unit is actuated in a substantially stepless manner by operating these brake shoe elements alternately in such a way that, in an operation involving a single, appropriately movable brake shoe element pressing into engagement with a brake flange, one or more movable brake shoe elements presently in a rest position are being returned relative to the brake flange to a standby position in anticipation of the next operation. Particularly in jack-up type offshore structures, as discussed above, or e.g. in offshore vessels of a liftboat type, it is advantageous to further control the motion of each leg or column by means of fixed brake shoe elements, arranged in conjunction with a frame structure and functioning largely as backup features principally similar to traditional locking systems. In this context, it is further preferred that the brake shoe system be designed with brake shoe elements, which in a standby condition are pressed in a self-powered, such as spring-biased manner, or in response to the gravity of a rig, into engagement with a brake disk system and, on the other hand, are disengaged therefrom in an operating condition in response to an auxiliary force, such as by the action of a hydraulically operating release mechanism.

The invention relates also to a maritime unit designed in accordance with the method.

The most important benefits gained by a maritime unit of the invention include its simplicity and reliability in operation. According to the invention, a maritime or offshore unit, provided with both brake disk and brake shoe systems, is implementable with extremely simple and reliable constructions which, unlike traditional solutions, are also adaptable to automation in such a way that the use of legs or columns in various situations does not necessitate any extra and tedious procedures, e.g. for locking the legs. Another essential benefit gained by a maritime or offshore unit of the invention is that the operation of the legs can be implemented in such a way that the manipulation thereof in all conditions proceeds in continuous and stepless actions. Thus, one significant benefit gained by a maritime unit of the invention lies in the fact that it enables the use of extremely simple constructions by avoiding the use of e.g. separate and expensive rack systems and locking systems, since the jack mechanisms to manipulate the legs are implementable by means of brake shoe/brake flange systems operating on quite simple principles.

BRIEF DESCRIPTION OF THE DRAWINGS

The invention will be described in detail in the following specification, while reference is made to the accompanying drawings, in which.

DETAILED DESCRIPTION OF EMBODIMENTS OF THE INVENTION

The invention relates to a method for operating a maritime unit 1, intended for seafaring, such as marine traffic, offshore operations, and/or the like, said maritime unit comprising a frame structure 2, which is provided with at least power production and/or drive assemblies for the maritime unit, and at least three legs 3 operated by a jack mechanism 5, on the one hand for steadying the maritime unit 1 on the seabed by driving the legs 3 from a standby position, as required by the maritime unit's shipping condition, downwards in a direction substantially vertical with respect to the frame structure 2 and, on the other hand, for releasing the same from the seabed by driving the legs 3 upward relative to the frame structure. At least the legs 3 of the maritime unit 1 are operated on a so-called disk brake principle for enabling a substantially stepless drive therefor, particularly regarding the manipulation and locking thereof, the maritime unit having each of its legs 3 provided with a brake disk system 3*a*, such as one or more brake flanges 3*a*' or the like, extending longitudinally of the leg and, on the other hand, the maritime unit having its frame structure 2 provided with a brake system 5*a*, such as one or more brake shoe elements 5*a*' or the like, operable in a vertical direction by means of a jack mechanism 5.

Figure 1:
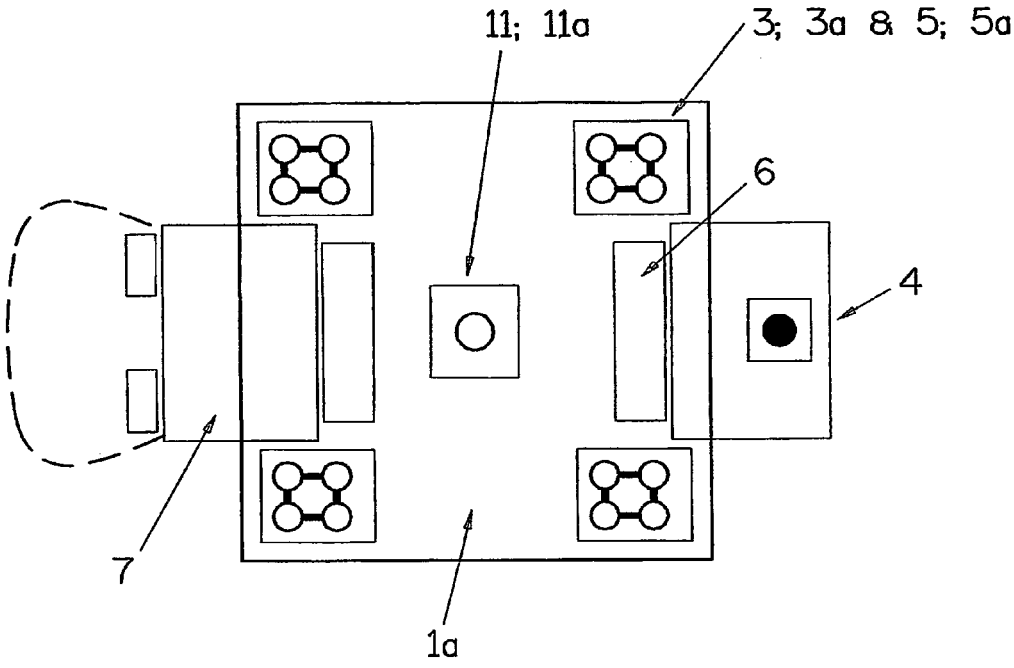
FIG. 1 shows in a plan view and in a drilling situation one jack-up type offshore rig suitable for applying the invention.
Figure 2:
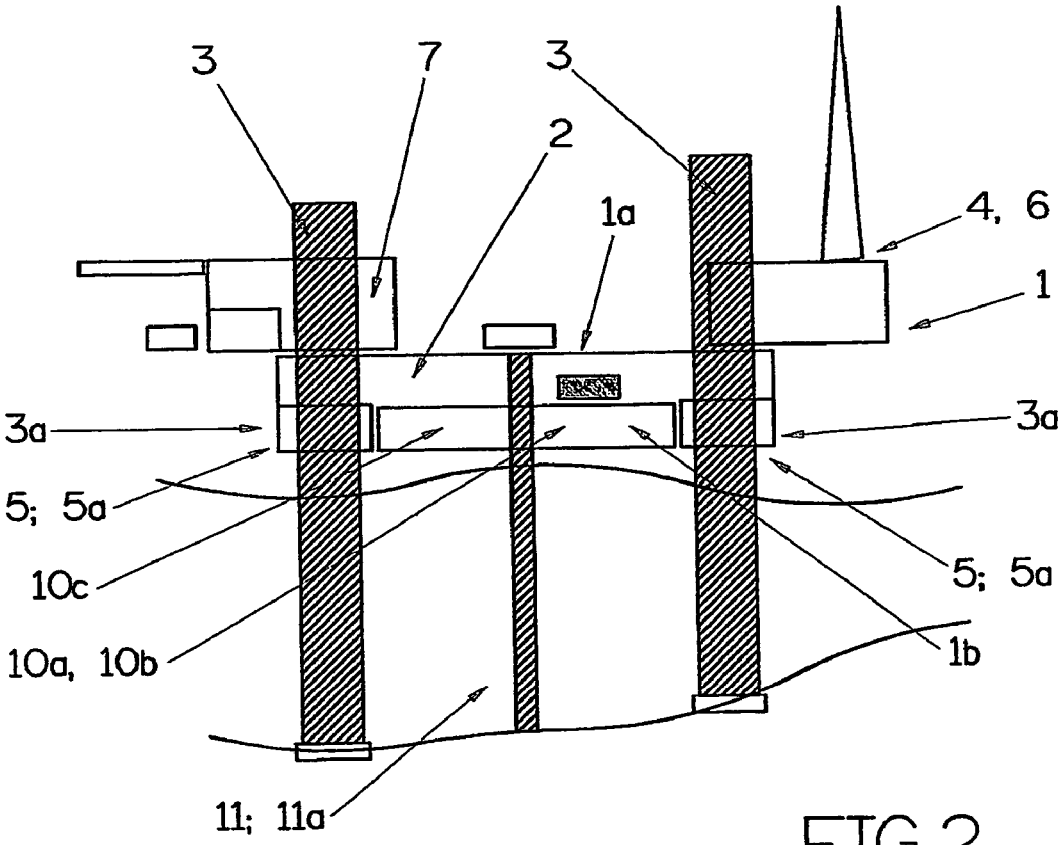
FIG. 2 shows the rig of FIG. 1 in a side view.
Figure 3:
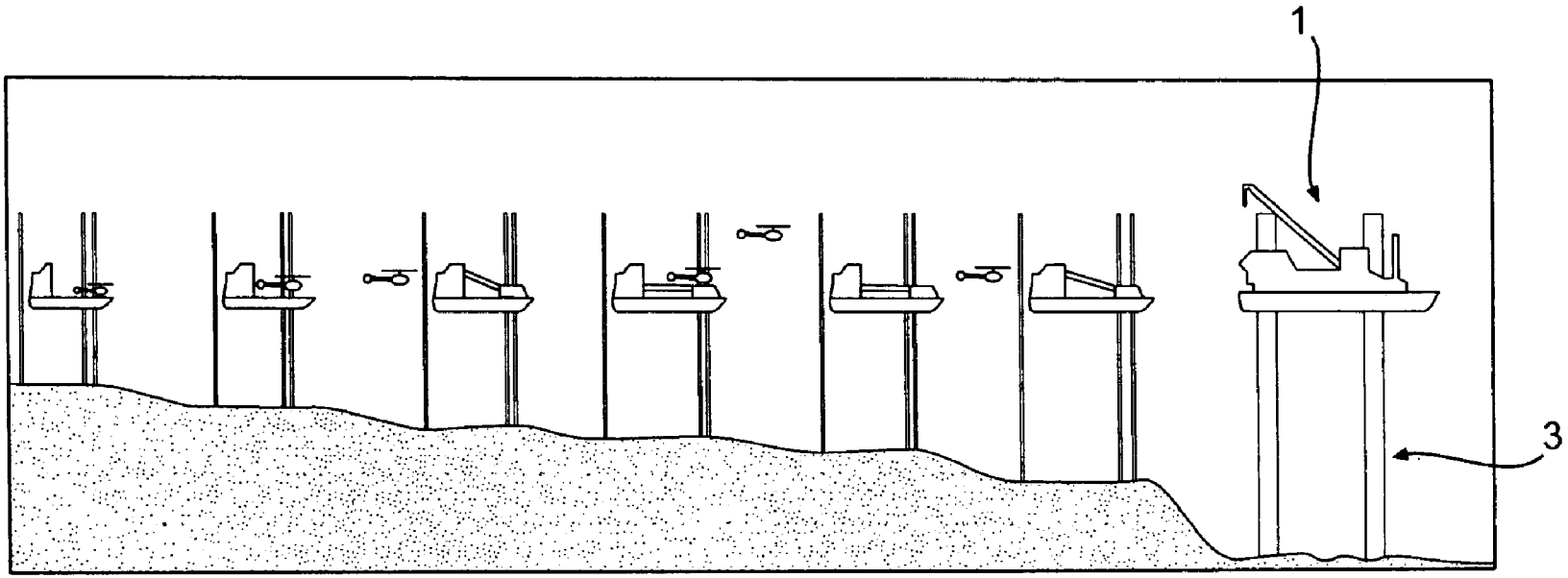
FIG. 3 shows examples of liftboat type offshore units, intended for various offshore depths.

Especially FIGS. 1 and 2 illustrate one particularly preferred application for the present invention. Thus, the jack-up type offshore rig 1 includes the frame or hull structure 2, provided with a working deck 1*a* and a substantially flat bottom 1*b* and having thereinside at least some of the power production and driving equipment for the offshore rig 1. In these solutions, the frame structure 2 is provided with four movable legs 3 for steadying the offshore rig 1 on the seabed in an anchoring procedure by descenting the same from a standby position, as required by the offshore rig's 1 shipping condition, relative to the frame structure 2 to a working position enabling a drilling operation, and for releasing the same from the seabed by hoisting the legs 3 upwards relative to the frame structure 2 in a disengagement procedure.

The foregoing solution includes a drilling unit 4, which is adapted to be movable in a substantially horizontal plane relative to the frame structure 2 by means of a first offset mechanism 6, such as electrically, pressure-medium operated and/or similar actuators or a slideway system or the like, for carrying out the drilling in a drilling operation essentially from outside the frame structure 2. In order to improve the offshore rig 1 in terms of its usability, regarding particularly the safety of engagement and disengagement procedures, the frame structure bottom or floor 1*b* is provided therebelow with an air space 10*a*, which is exhaustible for the offshore rig's shipping condition and constructed e.g. with portable wall elements 10*c*, and which can be injected with air by means of an injection assembly 10*b* for producing an air cushion underneath the frame structure 2 for the duration of the above-discussed procedures.

FIGS. 1 and 2 further depict a solution, which is advantageous in the sense that a drilling unit 4 and living quarters 7, included in the offshore rig, are both movable. In a drilling situation, as shown in FIGS. 1 and 2, both the living quarters 7 and the drilling unit 4 are offset partially outside the frame structure 2, especially for increasing the vacant working space 1*a* on the frame structure 2 available in a drilling operation. In a further preferred embodiment, the frame structure has its floor 1*b* strengthened by means of an additional bracing system 11, such as a deep water line 11*a*, an extra drill unit, and/or the like, whereby the frame structure has essentially the central portion of its floor 1*b* braced solidly on the seabed at least for the duration of a drilling operation. This enables increasing the stability of a relatively wide floor surface established by the discussed construction, especially in particularly difficult circumstances. Hence, it is naturally obvious that the principle used in a method of the present invention is applicable also in other mobile support systems, such as in the operation of the deep water line 11*a*.

In a preferred embodiment of the invention, the offshore unit has its leg or column 3 actuated on principles shown in FIGS. 5, 6 and 7*a*, by means of two or more brake shoe elements 5*a*', which are set one below the other in a vertical direction and apply their action on a single brake flange 3*a*' in a brake disk system 3*a* included therein, and which are operated by means of separate jack mechanisms 5; 5', such as hydraulic cylinders or the like.

Figure 5:
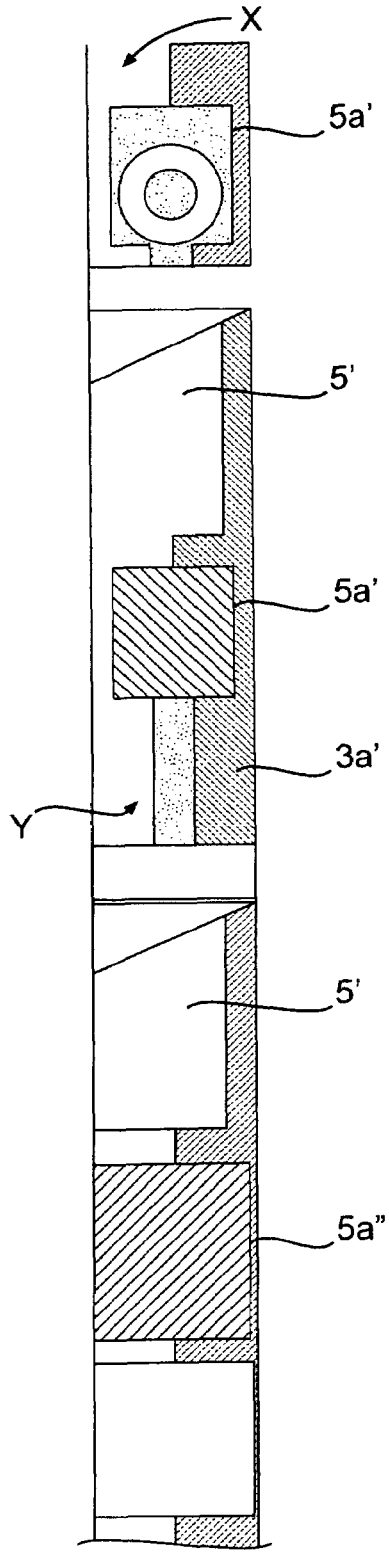
FIG. 5 shows in a side view a further preferred brake disk/brake shoe system applying a method of the invention.

In a further preferred embodiment of the invention, the offshore unit has each of its legs or columns 3 actuated in a substantially stepless manner by using alternately two or more brake shoe elements 5*a*' applying their action on a single brake flange 3*a*' in a brake disk system 3*a*, particularly on a principle shown e.g. in FIG. 5, such that during an operation x, involving one appropriately movable brake shoe element pressing into engagement with the brake flange 3*a*', one or more movable brake shoe elements presently in a rest position are being returned y relative to the brake flange 3*a*' to a standby position in anticipation of the next operation.

The movement of each leg 3 is preferably also controlled by means of one or more immobile brake shoe elements 5*a*" mounted in connection with the frame structure 2. In a further preferred embodiment, the maritime unit 1 has one or more of its immobile and/or mobile brake shoe elements 5*a*', 5*a*" first of all pressed in a standby condition in a self-powered, such as spring-biased manner, into engagement with the brake disk system 3*a* and, on the other hand, has the same disengaged therefrom in an operating condition in response to an auxiliary force, such as by the action of a hydraulically operating release mechanism. The above-discussed arrangements can be used for maximizing safety, such that, when e.g. the hydraulic system of an offshore unit malfunctions, there will be no risk as the brake shoe elements remain in a self-powered compressive engagement with the brake flanges.

Thus, the invention relates to a maritime or offshore unit for the above purpose. According to the invention, the offshore unit 1 has at least its legs or columns 3 adapted to be operated on a so-called disk brake principle for enabling a substantially stepless operation therefor, regarding especially the manipulation and locking thereof, the offshore unit having each of its legs 3 provided with a brake disk system 3*a*, such as one or more brake flanges 3*a*' or the like, extending longitudinally of the leg, and, on the other hand, the offshore unit has its frame structure 2 provided with a brake system 5*a*, such as one or more brake shoe elements 5*a*' or the like, movable in a vertical direction by means of a jack mechanism 5.

Figure 6:
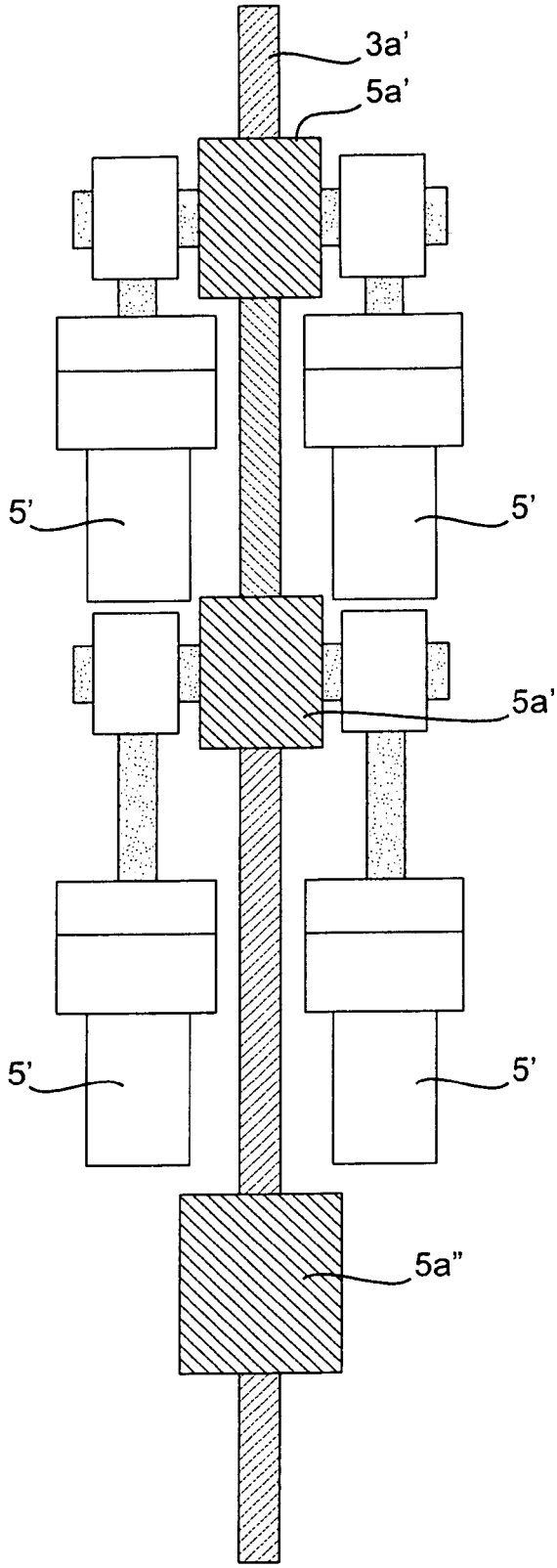
FIG. 6 shows in a frontal view the assembly consistent with FIG. 5.
Figure 7A:
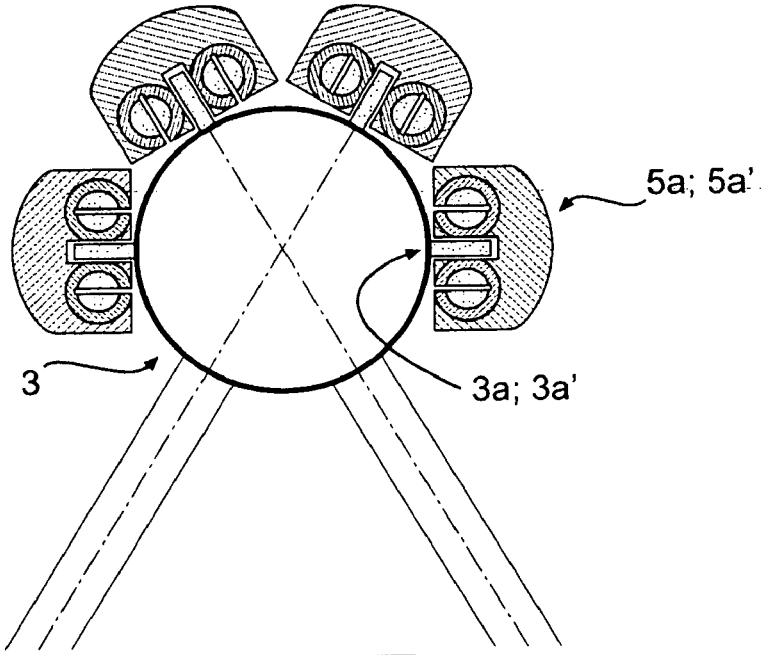
FIGS. 7*a* and 7*b* shows another system which is alternative to the solution depicted in FIG. 4.
Figure 7B:
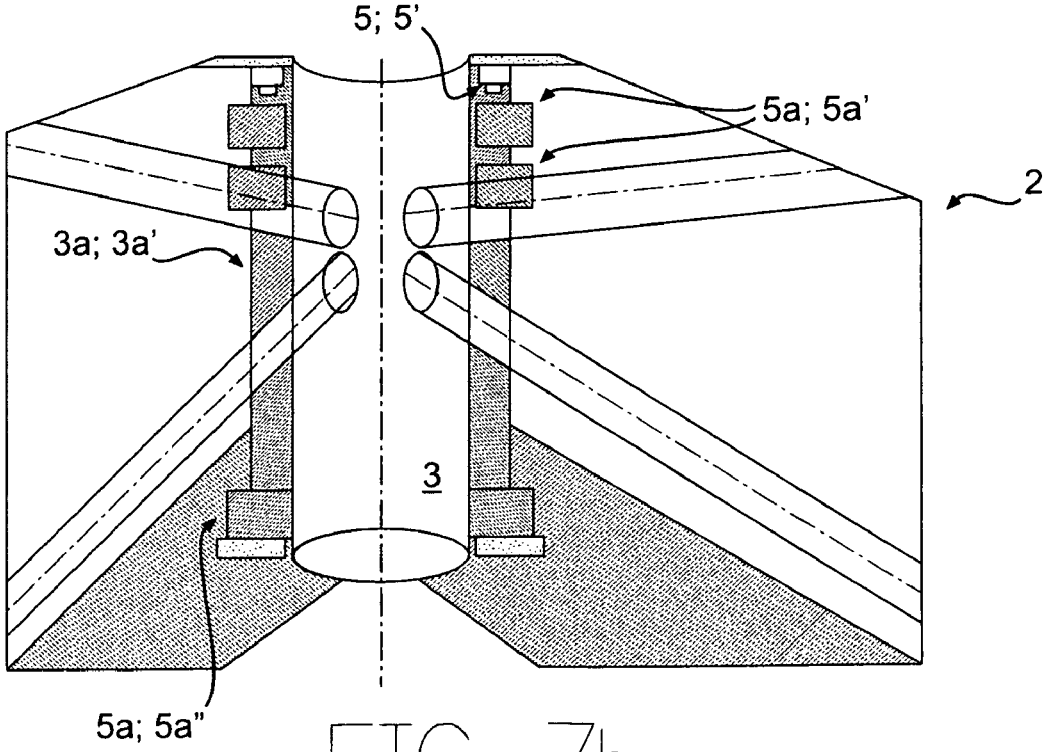

As shown in FIGS. 5, 6 and 7*a*, the brake disk system 3*a*, associated with each leg of the offshore unit, has one and the same brake flange 3*a*' arranged to be contacted preferably by two or more brake shoe elements 5*a*', which are set one below the other in a vertical direction and adapted to be operated by means of separate jack mechanisms 5; 5', such as hydraulic cylinders or the like. In a further preferred embodiment, especially in the maritime unit 1 intended for offshore operations, such as in a jack-up type offshore unit, a liftboat type offshore vessel, and/or the like, the brake shoe system 5*a* includes one or more brake shoe elements 5*a*", fixedly mounted on the frame structure 2 of the maritime unit 1, particularly for controlling the movement of each leg or column 3 in the maritime unit.

In this context, the maritime unit 1 has one or more of its immobile and/or mobile brake shoe elements 5*a*', 5*a*" further preferably adapted, first of all, to press in a standby condition in a self-powered, such as spring-biased manner, into engagement with the brake disk system 3*a* and, on the other hand, to disengage therefrom in an operating condition in response to an auxiliary force, such as by the action of a hydraulically operating release mechanism.

Figure 4:
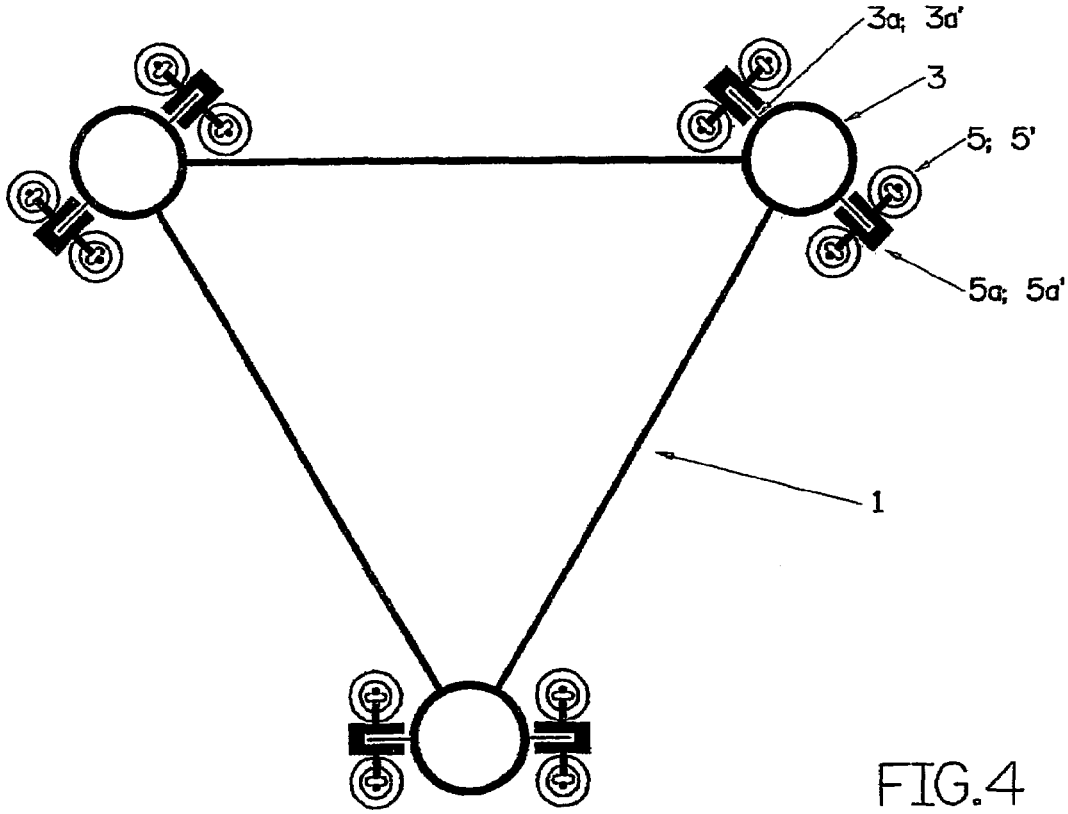
FIG. 4 shows one preferred system operated by a method of the invention for actuating the legs or columns of an offshore unit.

In a further preferred application, especially in reference to the embodiment shown in FIG. 4, the brake disk system 3*a*, provided on each leg of the maritime unit symmetrically in a cross-sectional view, is adapted to be lightened/cooled by using e.g. perforated, hollow and/or the like brake flanges 3*a*'. It is of course possible that, if necessary, the brake flanges be coated with corrosion-resistant, e.g. semicoarse metal platings.

It is obvious that the invention is not limited to the embodiments discussed or described above, but can be subjected to considerable modifications within the basic inventive concept. Hence, a method of the invention can be utilized in a multitude of technically varying constructions and general configurations in case of a maritime unit. In addition, it is of course possible to outfit an offshore unit with more equipment than what is described above, for example with conventional propeller mechanisms for enabling the self-propelled maneuvering of a maritime unit, and for example with anchoring systems designed according to the invention, etc.

Naturally, the offshore unit, constructed with a method of the invention, has its legs or columns provided, if necessary, with appropriate cleaning systems, especially for cleaning or washing the brake disks, included in a brake disk system, for removing seaweed, grease, or other debris interfering with braking. This type of solutions can be implemented e.g. with totally mechanical systems, or perhaps on ultrasound principle. In this context, it is naturally also possible to utilize e.g. pneumatic drying systems or the like. Therefore, a method of the invention can be further applied e.g. in such a way that the legs or columns of an offshore unit are lowered, if necessary, one by one, pairwise, or all together by releasing all brake systems, in which case it may be advisable to outfit the inventive maritime unit further with systems for monitoring the movement of the legs, such as acceleration sensors or the like, in such a way that, when the speed of movement exceeds a set threshold, the movement thereof is limited e.g. with immobile brake shoe elements.

The invention claimed is:

1. A method for operating a maritime unit comprising a frame structure, at least three legs moveable between a standby position and an extended position, a jack mechanism operative to move the legs between the standby position and the extended position, the method comprising:

actuating each leg of the maritime unit with a brake system comprising one or more brake flanges extending in a longitudinal direction of the leg, wherein each brake system is operatively connected to the frame structure and includes at least two brake shoe elements, wherein at least one of the brake shoe elements is movable, wherein the brake shoe elements act on one brake flange of the brake system, and wherein the at least one movable brake shoe element of each leg is operated in the vertical direction by means of a second jack mechanism such that each leg is moved in a substantially stepless manner.

2. The method according to claim 1, wherein at least one of the brake shoe elements is immobile.

3. The method according to claim 2, further comprising:

pressing at least one of the brake shoe elements into engagement with the brake system in a standby condition; and disengaging at least one of the brake shoe elements from the brake system in an operating condition in response to an auxiliary force.

4. The method according to claim 3, wherein the at least one brake shoe element is pressed into engagement with the brake system in the standby condition in a self-powered manner.

5. The method according to claim 3, wherein the at least one brake shoe element pressed into engagement with the brake system in the standby condition is spring-biased.

6. The method according to claim 3, wherein the auxiliary force comprises action of a hydraulically operating release mechanism.

7. The method according to claim 1, wherein the brake shoe elements are arranged one below the other in a vertical direction.

8. The method according to claim 1, wherein each brake system comprises at least two movable brake shoe elements, wherein each leg is actuated in a substantially stepless manner by alternately applying two or more movable brake shoe elements on a single brake flange in the brake system, such that while one of the movable brake shoe elements engages the single brake flange, one or more of the movable brake shoe elements in a rest position are returned to a standby position relative to the brake flange in anticipation of the next operation.

9. The method according to claim 1, wherein the jack mechanisms drive the legs downwards in a substantially vertical direction with respect to the frame structure.

10. The method according to claim 1, wherein the jack mechanisms release the legs from the seabed by driving the legs upward relative to the frame structure.

11. The method according to claim 1, wherein the jack mechanisms comprise hydraulic cylinders.

12. The method according to claim 1, wherein the maritime unit is adapted for offshore operations.

13. The method according to claim 1, wherein the maritime unit comprises at least one of a jack-up type oil drilling unit or a liftboat type offshore vessel.

14. A maritime unit, comprising:

a frame structure;

at least three legs moveable between a standby position and an extended position;

a jack mechanism operative to drive the legs from the standby position downwards in a direction substantially vertical with respect to the frame structure and operative to release the legs from the seabed by driving the legs upward relative to the frame structure; and a brake system comprising one or more brake flanges extending longitudinally with respect to the legs and comprising at least two brake shoe elements arranged one below the other in a vertical direction, wherein at least one of the brake shoe elements is movable, whereby the brake shoe elements act on one brake flange of the brake disk system and are operated in the vertical direction by separate jack mechanisms, and wherein the legs of the maritime unit are operated on a disk brake principle for enabling a substantially stepless drive therefore.

15. The maritime unit according to claim 14, wherein the brake system further comprises one or more immobile brake shoe elements fixedly mounted on the frame structure of the maritime unit.

16. The maritime unit according to claim 15, wherein at least one of the movable brake shoe elements is adapted to press in a standby condition in a self-powered manner into engagement with the brake system and to disengage from the brake system in an operating condition in response to an auxiliary force.

17. The maritime unit according to claim 16, wherein the auxiliary force comprises action of a hydraulically operating release mechanism.

18. The maritime unit according to claim 16, wherein the self-powered manner comprises a spring-biased manner.

19. The maritime unit according to claim 14, wherein the jack mechanisms comprise hydraulic cylinders.

20. The maritime unit according to claim 14, further comprising:

at least one power production and/or drive assembly operatively connected to the frame structure.

21. The maritime unit according to claim 14, wherein the legs are arranged in the standby position during shipping of the maritime unit.

22. The maritime unit according to claim 14, wherein the legs are operative to steady the maritime unit on a seabed.

23. The maritime unit according to claim 14, wherein the maritime unit is used to perform offshore operations.

24. The maritime unit according to claim 14, wherein the offshore operations include the use of at least one of a jack-up oil drilling unit or a liftboat type offshore vessel.

25. The maritime unit according to claim 14, wherein a brake system is provided on each leg of the maritime unit.

26. The maritime unit according to claim 25, wherein the brake system is provided on each leg symmetrically in a cross-sectional view.

27. The maritime unit according to claim 14, wherein the brake flanges are perforated and/or hollow.

* * * * *